US010810913B2

(12) United States Patent
Gonchar

(10) Patent No.: US 10,810,913 B2
(45) Date of Patent: Oct. 20, 2020

(54) UNIVERSAL FIRE ALARM REFLECTIVE SYSTEM

(71) Applicant: Nicolas Gonchar, Brea, CA (US)

(72) Inventor: Nicolas Gonchar, Brea, CA (US)

( * ) Notice: Subject to any disclaimer, the term of this patent is extended or adjusted under 35 U.S.C. 154(b) by 0 days.

(21) Appl. No.: 16/390,678

(22) Filed: Apr. 22, 2019

(65) Prior Publication Data

US 2020/0043389 A1 Feb. 6, 2020

Related U.S. Application Data

(60) Provisional application No. 62/713,347, filed on Aug. 1, 2018.

(51) Int. Cl.

| | |
|---|---|
| ***G09F 13/16*** | (2006.01) |
| ***G08B 5/00*** | (2006.01) |
| ***G09F 21/02*** | (2006.01) |

(52) U.S. Cl.

CPC ..... *G09F 13/16* (2013.01); *G08B 5/00* (2013.01); *G09F 21/02* (2013.01)

(58) Field of Classification Search

CPC ..... G09F 13/16; G09F 21/02; G08B 5/00
See application file for complete search history.

(56) References Cited

U.S. PATENT DOCUMENTS 4,679,822 A * 7/1987 Wolfe ..... G09F 3/00 206/225
5,309,863 A * 5/1994 Leeb, Jr. ..... G08B 7/062 116/205
5,325,279 A 6/1994 Freelove et al.
5,514,441 A * 5/1996 Pohto ..... C09D 175/06 359/536
5,724,910 A 3/1998 Annesley et al.
6,114,948 A 9/2000 Astell
6,222,455 B1 * 4/2001 Kaiser ..... G08B 5/002 340/577
6,859,145 B2 * 2/2005 Wilker ..... G08B 7/066 340/539.14
7,196,614 B2 3/2007 Carolan
7,321,301 B2 1/2008 Spoltore et al.
7,523,871 B1 * 4/2009 Wilson ..... G06Q 20/346 235/487
7,528,700 B2 * 5/2009 Picard ..... G08B 7/062 340/286.05
7,659,527 B1 2/2010 Seibert et al.
7,746,247 B2 * 6/2010 Kimbrough, Jr. ..... A41D 13/01 340/907
8,896,427 B1 11/2014 Ramirez
(Continued)

OTHER PUBLICATIONS

Alert-All, The Leader in Fire Safety Education [online] (Feb. 17, 2006). (Year: 2006).*

(Continued)

*Primary Examiner* — Nimeshkumar D Patel
*Assistant Examiner* — Tania Courson

(57) ABSTRACT

A system and method of communication with first responders includes a reflective device and coupling the reflective device to a surface of a dwelling. The reflective device is indicative of at least one of occupants of the dwelling and hazardous materials disposed within the dwelling. A fireman or paramedic may shine there light and determine what type of occupants are in the building and if there are any hazardous materials to be concerned about.

3 Claims, 8 Drawing Sheets

Light from a flashlight cuts through the smoke and darkness and the reflectors are bright, reflecting light, visible to a first responder

(56) References Cited

U.S. PATENT DOCUMENTS 8,943,722 B2 * 2/2015 Barrett ..... G09F 7/18 116/200
D769,534 S * 10/2016 Hanna ..... H04M 11/04 D2/870
10,220,767 B2 * 3/2019 Lee ..... B60J 1/18
2002/0076518 A1 * 6/2002 Ito ..... B32B 7/04 428/40.1
2004/0040194 A1 * 3/2004 Arraut ..... G09F 3/20 40/654.01
2004/0267685 A1 * 12/2004 Sharland ..... G06Q 90/00 706/62
2005/0104741 A1 5/2005 Kimbrough
2005/0152142 A1 * 7/2005 Traynor ..... E01F 9/559 362/249.01
2005/0174251 A1 8/2005 Terry
2006/0086024 A1 * 4/2006 Kennedy ..... G09F 7/00 40/597
2006/0131869 A1 * 6/2006 Brignull ..... B42D 25/00 283/74
2007/0006795 A1 1/2007 Muchin et al.
2007/0144047 A1 * 6/2007 Singh ..... A44C 5/0015 40/633
2007/0186842 A1 * 8/2007 Pharo ..... G07C 11/00 116/200
2007/0291473 A1 * 12/2007 Traynor ..... B60Q 7/00 362/106
2008/0276515 A1 11/2008 Kull
2009/0015397 A1 * 1/2009 Eardley ..... H04M 11/04 340/539.11
2011/0056510 A1 * 3/2011 Westlake ..... A01K 11/005 132/319
2011/0095895 A1 4/2011 Chero et al.
2012/0023793 A1 2/2012 Williams
2014/0338238 A1 11/2014 Barrett
2015/0179028 A1 6/2015 Bairaktaris
2015/0269875 A1 * 9/2015 Corcoran ..... G08B 25/009 40/553

OTHER PUBLICATIONS

TOT FINDERTM Fire Safety Program [online] (Feb. 17, 2006). (Year: 2006).*

* cited by examiner

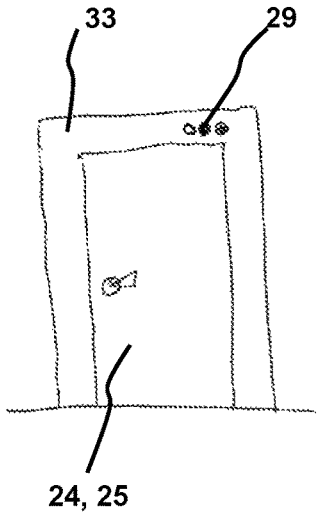

FIG. 20a

Door before an emergency such as a fire

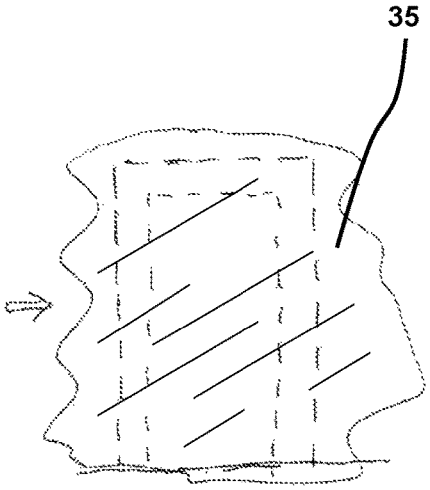

Visibility of the door is impaired or does not exist due to smoke and darkness

FIG. 20b

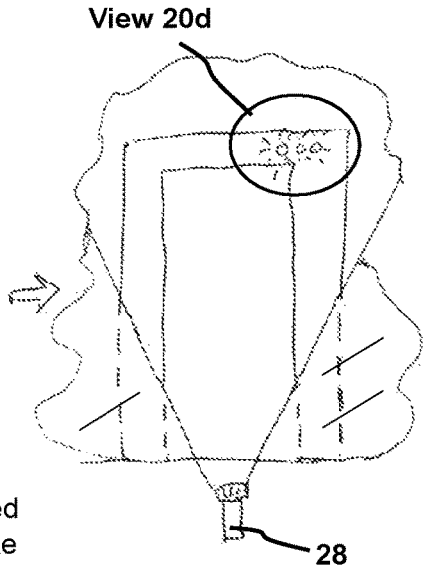

FIG. 20c

Light from a flashlight cuts through the smoke and darkness and the reflectors are bright, reflecting light, visible to a first responder

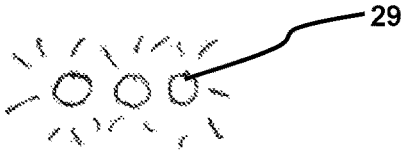

FIG. 20d

Light from a flashlight cuts through the smoke and darkness and the reflectors are bright, reflecting light, visible to a first responder

UNIVERSAL FIRE ALARM REFLECTIVE SYSTEM

CROSS-REFERENCE TO RELATED APPLICATION

This application claims the benefit of priority of U.S. provisional application No. 62/713,347, filed Aug. 1, 2018, the contents of which are herein incorporated by reference.

BACKGROUND

A reflective system for first responders is disclosed. More particularly, to a reflective system for first responders that indicates occupants and hazardous materials within a dwelling.

First responders, such as fireman and paramedics, handle emergencies in low light situations. First responders may struggle in the darkness with their flashlights. If any warning signage exists on a structure, its placement is not uniform to any non-existing code and not visible under the duress of the dangers of smoke, fire and pitch-black darkness.

As can be seen, there is a need for a reflective system for first responders that indicates occupants and hazardous materials within a dwelling.

SUMMARY

The application of the disclosure is to forewarn first responders to the specifics, of apparent ratings of moderate, severe and extreme dangers; along with the structure's potential occupants, pets and items that are potentially hazardous. A first responder, such as fire fighters, approaching a burning structure will be alerted to whom and what living things need their attention. First responders will also be warned of potential dangers, of explosions and other stored items; that are flammable, toxic and items that are not breathable or radioactive.

Until now, if any warning signage exists on a structure, its placement is not uniform to any non-existing code and not visible under the duress of the dangers of smoke, fire and pitch black darkness. First responders struggle in the darkness with their flashlights. The present disclosure provides a system for the reflection of these reflective icons that are caught on the flashlight's beam; alerting the first responders.

Due to the intuitiveness of the ender users, in the use of the icons; they are actually attempting to gain preference, by alerting and inviting first responders to their rescue.

Depending on the progress of the smoke from the fire engulfing the structure amidst pitch black darkness, the first responder directs his flashlight in the direction of the coded reflective colored icon/ornament or taped surface. The coded display, for example (a sampling of suggested colors), will reveal the presences of handicapped (baby blue), pet (green), senior (purple), children (pink), toxic (red), explosive (yellow) and radioactive (orange). Sub category for pets, green with white is cat, green with black is dog and green with blue is bird. Iconic shapes of cats and dogs can be created/offered in their conforming colors. As the system matures with popularity, other coding colors, categories and sub categories will be added and/or modified.

It is the formulation and/or transformation of common items into a recognition system and/or coded system that informs and alerts first responders, to specific details, alarms and dangers; present at a specific and/or unknown structure on fire. The inventor hopes, by displaying iconic colors and/or shapes, that these reflective warning system be recognized by first responders—as a universal fire and/or safety language. This being intellectually similar to a virtual and/or abstract, Morse Code for safety.

In one aspect of the embodiments herein, a method of communication comprises of providing a reflective device; and coupling the reflective device to a surface of a dwelling, wherein the reflective device is indicative of at least one of occupants of the dwelling and hazardous materials disposed within the dwelling. These and other features, aspects and advantages of the present invention will become better understood with reference to the following drawings, description and claims.

BRIEF DESCRIPTION OF THE DRAWINGS

FIG. 20 shows three stages of an emergency, such as a fire, wherein FIG. 20*a* is prior to the emergency, FIG. 20*b* is during the emergency, FIG. 20*c* is when the door and the reflectors are visible due to a flashlight, and FIG. 20*d* is an enlarged view of View 20*d* showing the light reflected off the reflectors.

DETAILED DESCRIPTION

Figure 1:
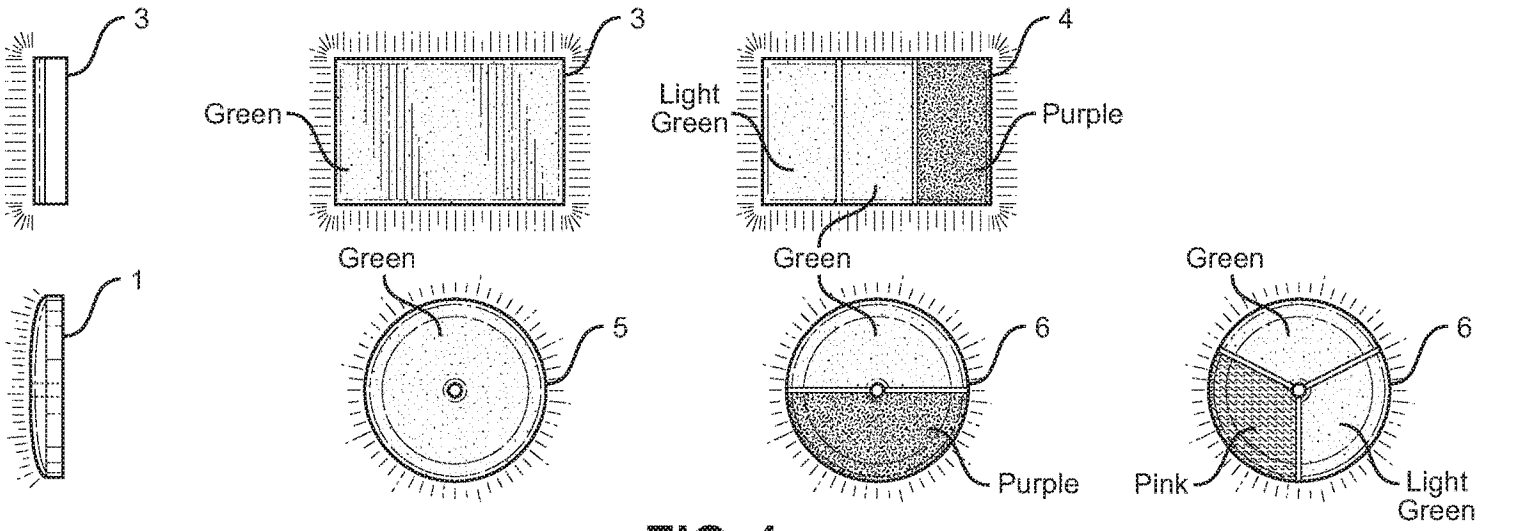
FIG. 1 is an Assortment of Basic Single and Multiple Color Reflective Face Shapes.
Figure 2:
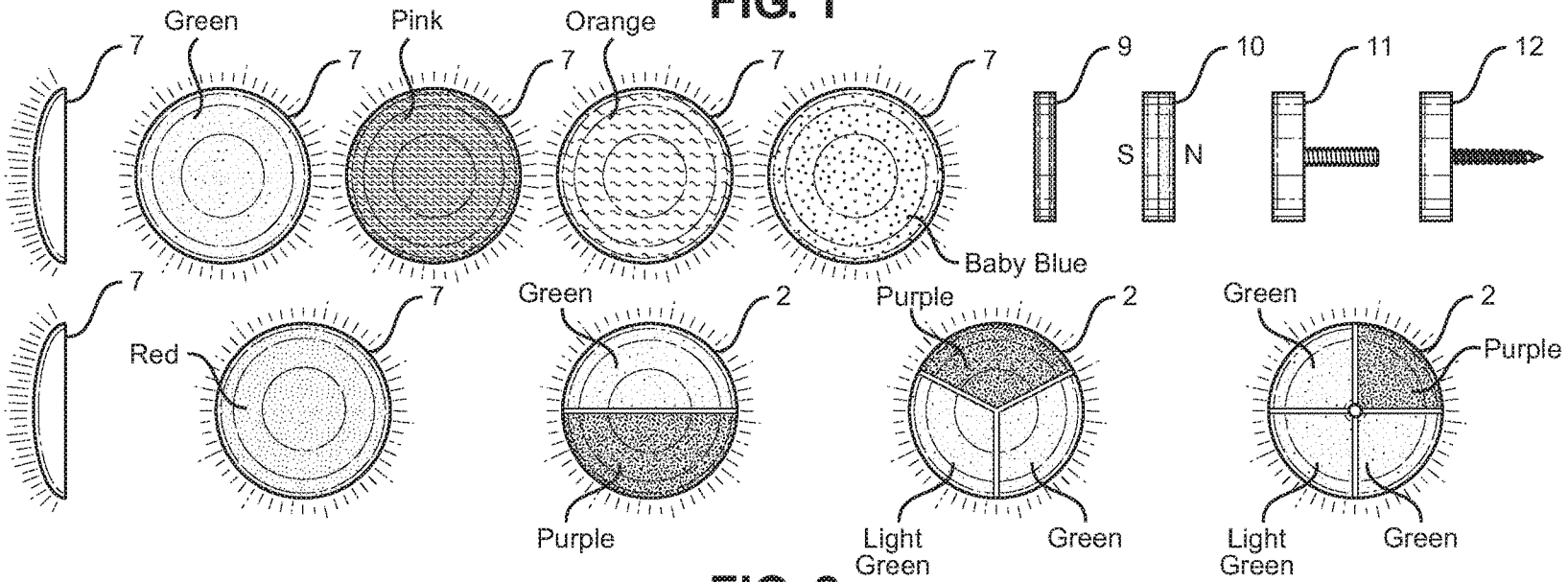
FIG. 2 is an Assortment of Single and Multiple Color Reflective Face Shapes, and an Assortment of Mounting Options.
Figure 3:
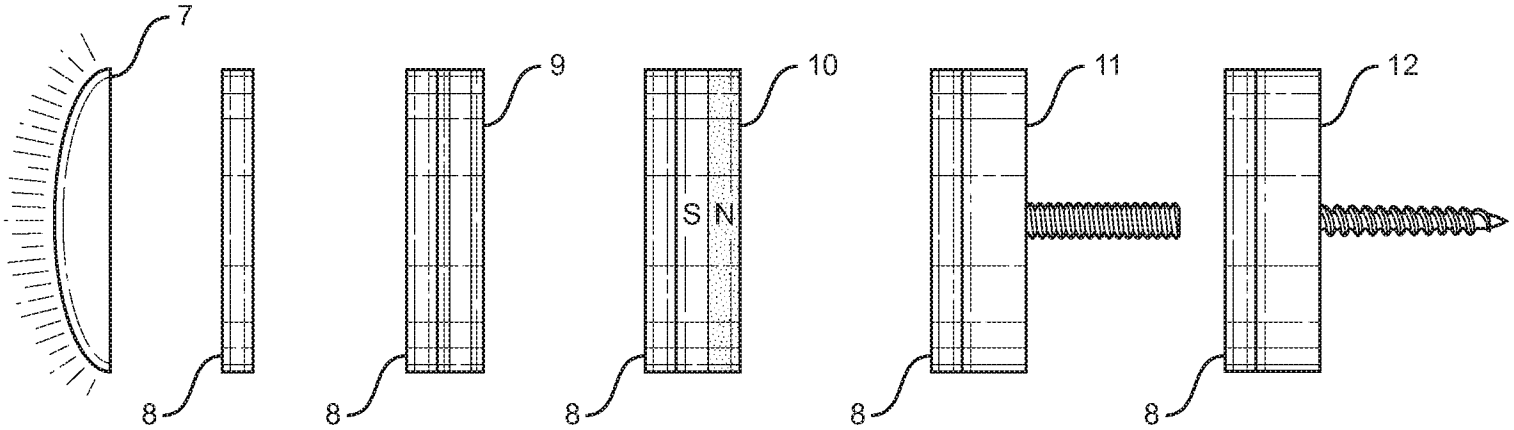
FIG. 3 is an image of a Lens-Shaped Single Reflective Face, and an Accompanying Backing Plate Attached to an Assortment of Mounting Options.
Figure 4:
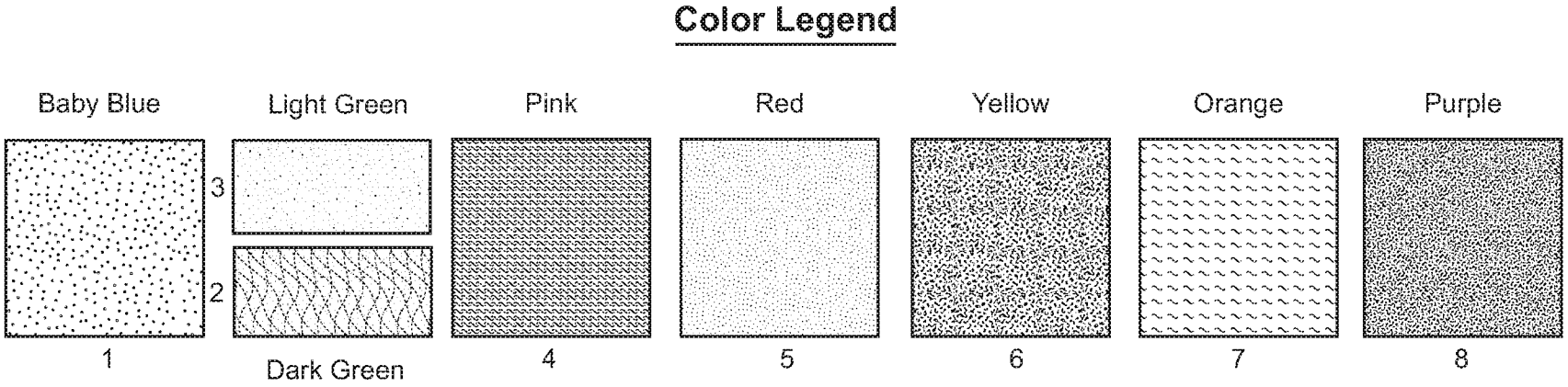
FIG. 4 is a Proposed Color Code Legend of an embodiment of the present invention.
Figure 5:
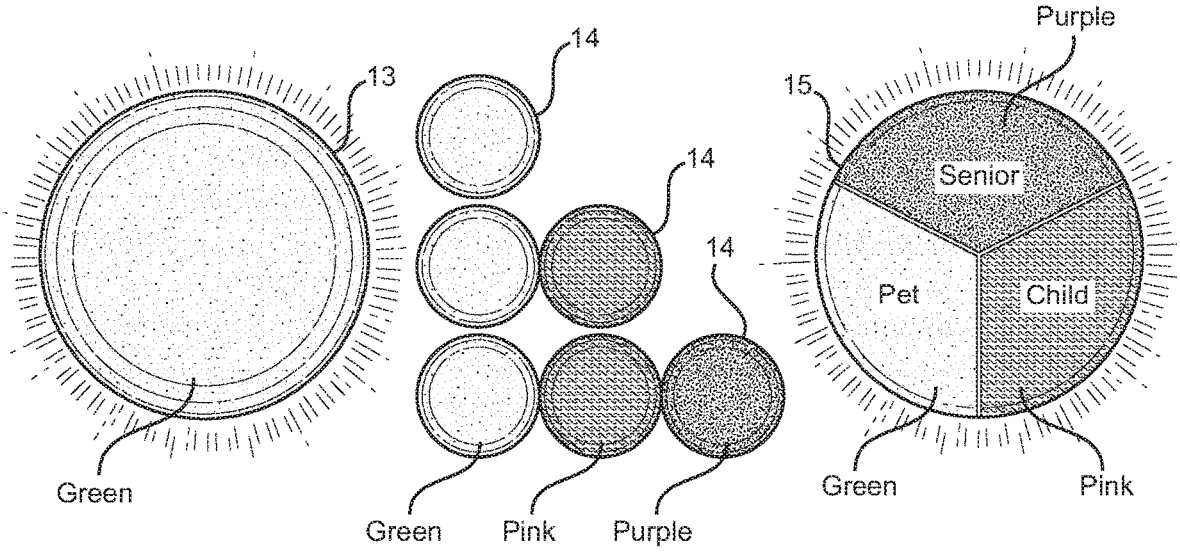
FIG. 5 is an Assortment of Circular Metal or Plastic, Tape or Film Single and Multiple Color Reflective Faces.
Figure 6:
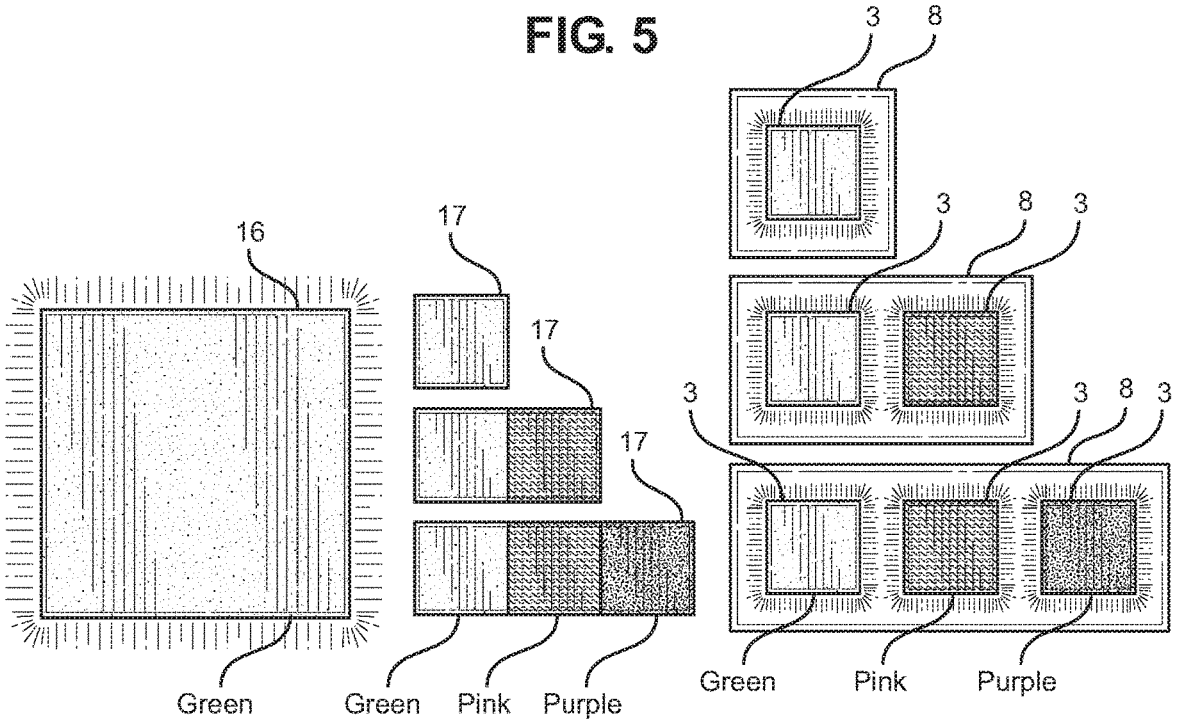
FIG. 6 is an Assortment of Square Metal, Plastic. Tape or Film Reflective Face Shapes and Accompanying Backing Plates. The Backing Plate Mounts to the Permanent Surface, then the Reflector Mounts to the Backing Plate.
Figure 7:
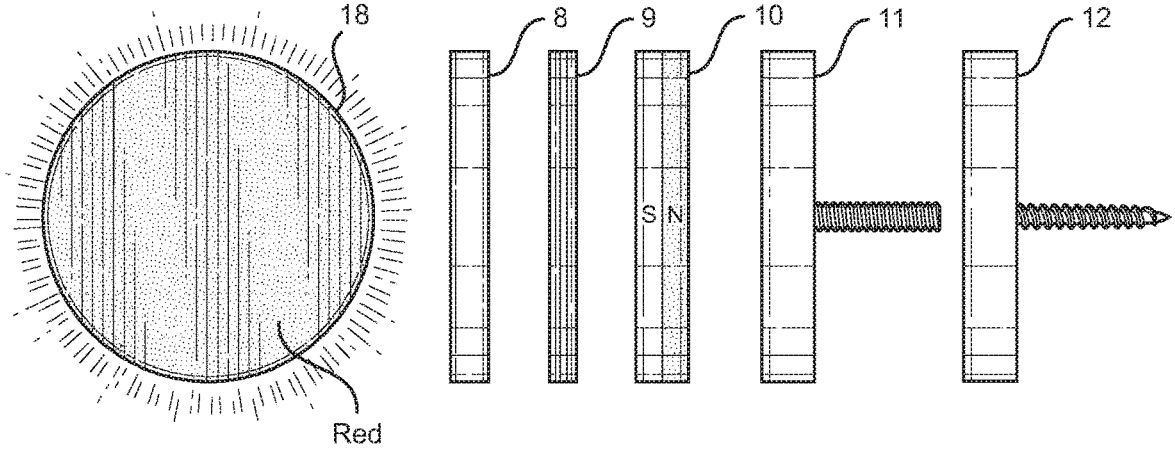
FIG. 7 is an image of a Circular Single Reflective Face Shape, and an Assortment of Mounting Options.
Figure 8:
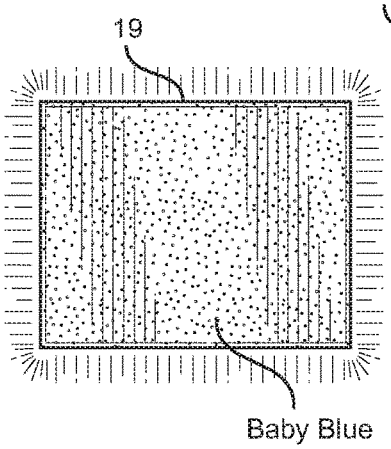
FIG. 8 is an Alternate Rectangular Single Reflective Face Shape.
Figure 9:
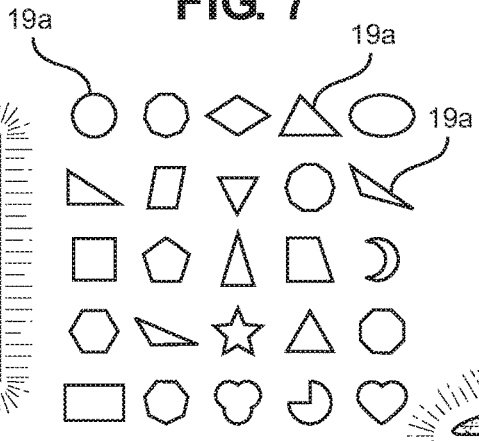
FIG. 9 are Examples of Possible Reflector Shapes.

As stated above, the embodiments described is to forewarn first responders to the specifics, of apparent ratings of moderate, severe and extreme dangers; along with the structure's potential occupants, pets and items that are potentially hazardous. A first responder approaching a burning structure will be alerted to whom and what living things need their attention. First responders will also be warned of the potential dangers, of stored explosives and toxic items that are not breathable or radioactive.

It is a system of reflective or non-reflective, colored or non-colored icons/ornaments or tape of standard geometric or custom; one, two or three dimensional shapes displayed at one or more key entry points to a premises, warehouses or structures (collectively referred to as "dwelling" and dwelling is to include, but not limited to homes, commercial buildings, hotels and motels, garages, warehouses, cruise ships, trains and places that a person can occupy). The reflection is created by the use of an ordinary hand held or helmet flashlight, typically carried by first responders.

The disclosure herein differs from what currently exists. Applicant believes that there is nothing currently existing to advise first responders to the occupants, the number of occupants, other living things and/or items residing or stored in the structure on fire; nothing currently exists to advise first responders to the occupants and/or items residing or stored in the structure on fire. Heavy smoke and pitch black darkness, typically obscure any good intended signage.

First responders struggle in the darkness and smoke during the emergencies and fire, and the reflection of these reflective icons designed to catch and reflect the flashlight's beams alert the first responders and providing direction during this chaos. There is no need to read any letters or lengthy instructions.

The present system of a combination of colored reflective lights that are attached to a specific and standardized location on the door or threshold, a legend of what each color designates and activated by a common light source, such as a flashlight, is very helpful in emergency situations. The present system is to be used during the chaotic conditions of a residential, commercial or industrial fire; when low light, darkness or heavy smoke shield and bar visibility. The onset of a fire upon the dwelling or building structure, under the circumstances of low light, smoke and/or darkness, that potentially obstructs, shields and hampers visibility to the door or threshold or an entry way and beyond into the inside the dwelling/building structure.

When it would be of a great benefit for first responders, who seek to enter the dwelling or structure, and for the persons and other living things inside the chaotic fire, being able to receive a quick notice of the occupants and other important contents through jus shining his or her flashlight onto the present system, piercing through all that smoke and darkness. Moreover, during this same chaotic conditions the present system could be used as entry door locator, especially under conditions in apartment houses, hotels and cruise ships that are the most affected by the combination of low light, darkness and heavy smoke. Thus this system uses a code that is readily understood or understandable by emergency responders with the details revealing the persons and other living things and the potential hazards inside the chaotic fire. Moreover, a legend of color coded icon reflectors may also be posted on or near the icons or at the main entrance, giving quick reference to the codes used. Posting a legend, however, is not required at onsite location. This is be considered common knowledge of a professional first responder or an advised bystander.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a color coded reflective system to forewarn first responders to the specifics, of apparent ratings of moderate, severe and extreme dangers; along with the structure's potential occupants, pets and items that are potentially hazardous. A first responder approaching a burning structure are alerted to, whom and what living things need their attention. First responders are also warned of potential dangers, of explosives and other stored items. These items could be flammable, toxic, radioactive and that are not breathable.

The system includes reflective, colored or non-colored icons/ornaments or tape of standard geometric or custom and one-, two-, or three-dimensional shapes displayed at one or more key entry points to a premises, warehouses or structures. The reflection is created by the use of an ordinary beam of light, created by common handheld, body attached or helmet flashlight, typically carried by first responders.

Referring to FIGS. 1 through 13, the present invention may include the following elements:

1: is a Round Shape Single Reflective Face
2: is a Lens-Shaped Multiple Color Reflective Face
3: is a Rectangular Single Reflective Face
4: is a Rectangular Multiple Color Reflective Face
5: is a Round Shape Single Reflective Face with Screw or Bolt Mounting Hole
6: is a Round Shape Multiple Color Reflective Face with Screw or Bolt Mounting Hole
7: is a Round Lens-Shaped Single Reflective Face
8: is a Backing Plate
9: is the Double Sided Tape
10: is a Magnetic Plate
11: is a Bolt Plate
12: is a Screw Plate
13: is a Metal or Plastic Round Shape Single Reflective Face
14: is a Group of Connected Metal or Plastic Round Shapes of Reflective Faces of a Specific Color
15: is a Metal or Plastic Round Shape Multiple Color Reflective Face of Specific Colors
16: is a Square Metal, Plastic, Reflective Tape or Film Shaped Single Reflective Face of Specific Colors
17: is a Group of Side by Side Metal or Plastic Square Shapes of Reflective Faces
18: is a Round Shape Single Reflective Face with Rounded Edges
19: is a Rectangular Shape Single Reflective Face with Rounded Edges
**19*a***: Any Geometric Shape
**19*b***: Ornamental Shape; Dog, Cat, Horse, Woman, Man and/or etc.
20: is a Diamond Shaped Plate with Multiple Small Round Reflective Faces
21: is a Round Shape Single Reflective Face Attached to a Wound Cord; to be Worn as a Pendant, Bracelet Charm, or Pet Collar
22: is a Rectangular Shaped Plate with Multiple Rectangular Reflective Faces of Varying Size for Creative Ornamentation

23: is a dwelling
24: is a point of entry
25: is a door
26: is a window
27: is a fire responders or a fire fighter or an emergency worker
28: is a flashlight
29: is a of reflective device, shown as a group of reflective devices
30: is a stairway in a dwelling
31: is an occupant of a dwelling, shown as a handicapped person
32: is hazardous materials
33: is a door frame
34: is a door threshold
35: is low light, smoke or darkness condition.

The present invention includes a system and method of communication with first responders. The system and method includes a reflective device 1 and coupling the reflective device 1 to a surface of a dwelling. The reflective device 1 is indicative of at least one of occupants of the dwelling and hazardous materials disposed within the dwelling. Therefore, a fireman or paramedic may shine their light and determine what type of occupants are in the building and if there are any hazardous materials to be concerned about.

In certain embodiments, a reflective device 4 may include plurality of reflective colors. Each of the plurality of reflective colors indicates a different type of occupant or a different type of hazardous materials. For example, baby blue may indicate a handicapped individual is within the dwelling, dark green may indicate a dog is within the dwelling, light green may indicate a cat is in the dwelling, pink may indicate a child is in the dwelling, red may indicate a toxic material is within the dwelling, yellow may indicate an explosive is within the building, orange may indicated a radioactive material is within the dwelling, and purple may indicate a senior is within the dwelling.

The present invention may further include a wearable reflective item 21. The wearable reflective item 21 may be worn by the occupant that matches a corresponding reflective color of the reflective device 4. For example, seniors may have a purple wearable reflective item 21, and children may have a pink wearable reflective item 21 to allow the first responders to recognize who the occupants are without fully seeing them.

The reflective device of the present invention may be coupled to the surface by different attachment devices. For example, the reflective device may be coupled to the surface by a bolt or screw, a magnet, an adhesive and the like. The reflective device may be coupled near an entrance of the dwelling, at the stairway of a dwelling, or anywhere else that it is easily viewable by a first responder.

Figure 10:
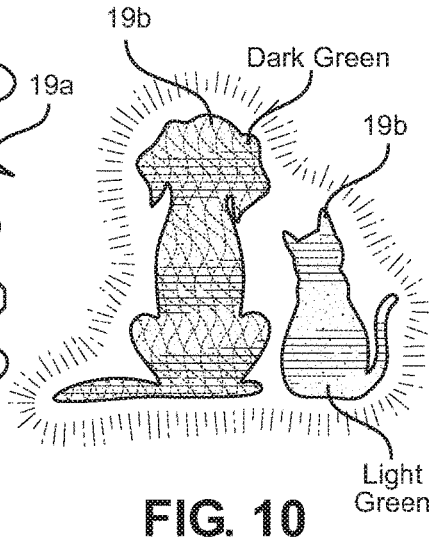
FIG. 10 is a Sample Creative Ornamental Shape of a Dog and a Cat.
Figure 11:
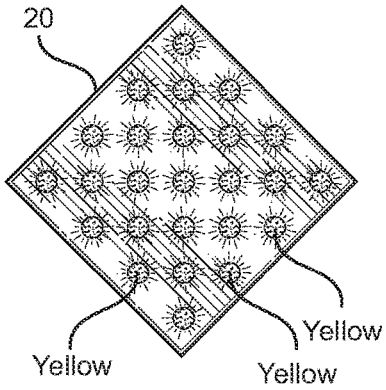
FIG. 11 is a Diamond Shaped Plate with a Multiple Small Round Reflective Face.
Figure 12:
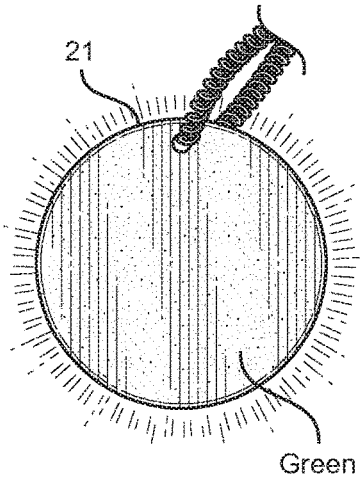
FIG. 12 is a Circular Single Reflective Face Shape Attached to a Wound Cord, to be worn as a necklace pendant, bracelet charm or attached to pet collar.
Figure 13:
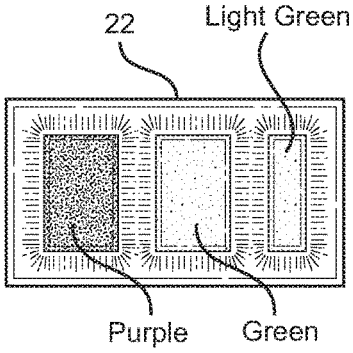
FIG. 13 is a Rectangular Shaped Plate with Multiple Rectangular Reflective Faces of Varying Size as an Example of Creative Styles for Ornamentation.
Figure 14:
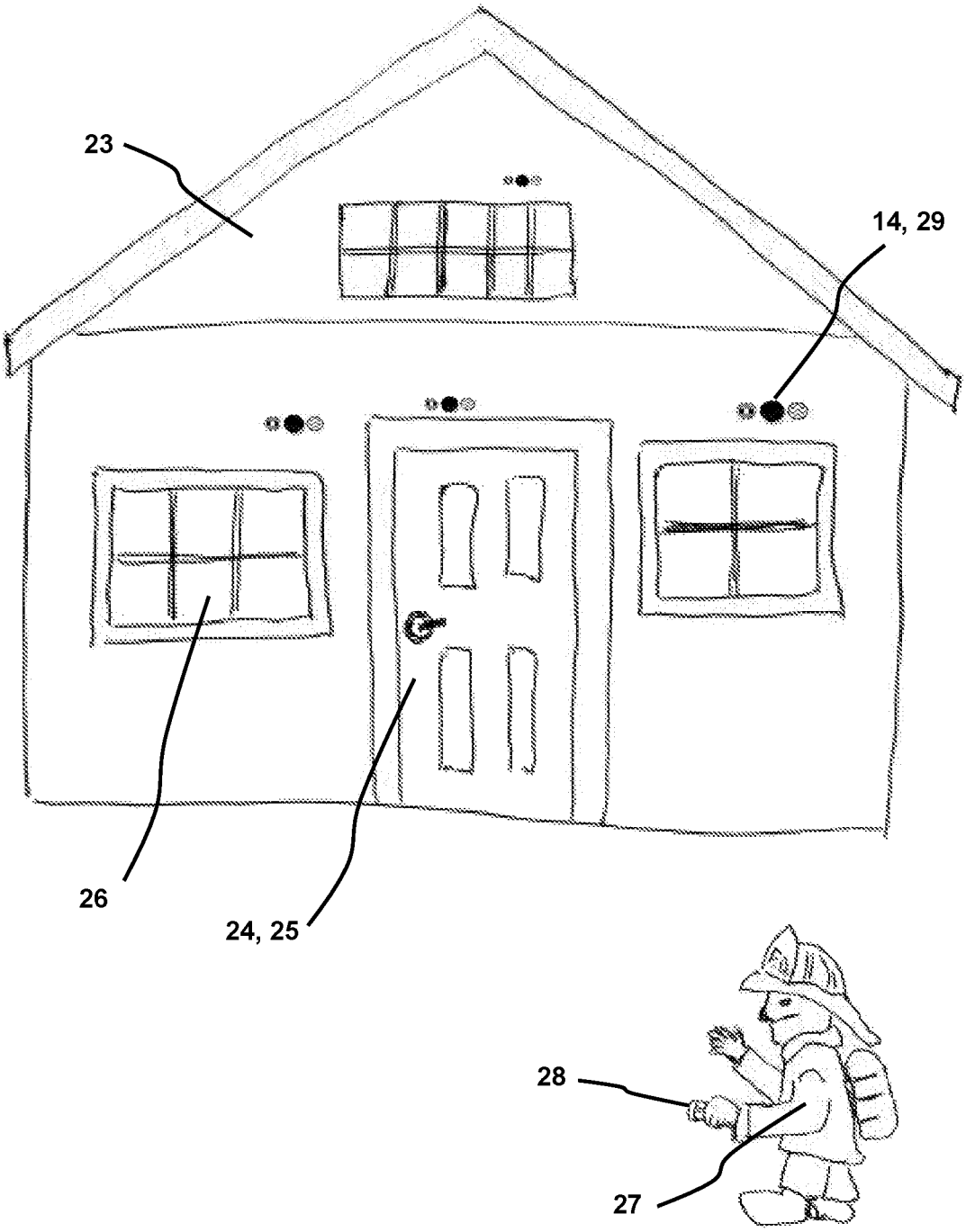
FIG. 14 is a dwelling with various points of entry, a door and windows, having the present invention coupled nearby, wherein a fire fighter with a flashlight can see the reflected lights off the reflective devices.
Figure 15:
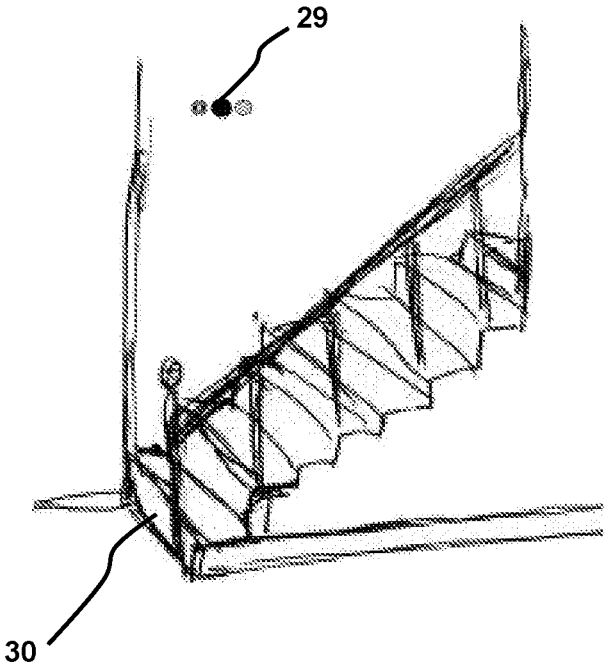
FIG. 15 is a dwelling with a stairway having the present invention coupled nearby.
Figure 16:
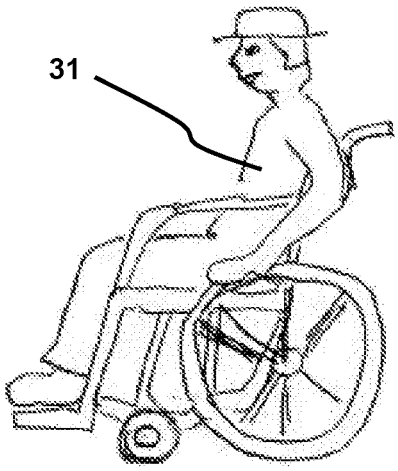
FIG. 16 is an occupant.
Figure 17:
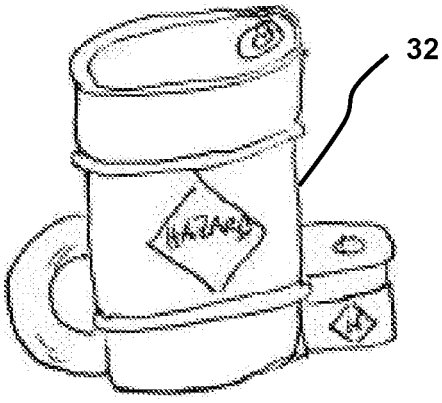
FIG. 17 is potential hazardous materials in the dwelling.
Figure 18:
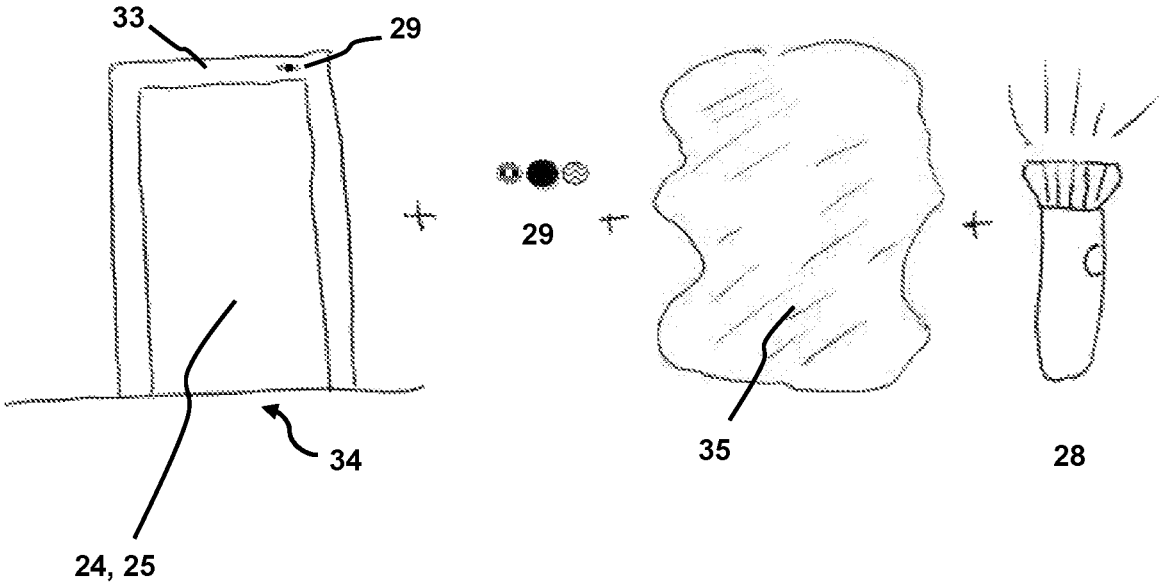
FIG. 18 is a door with a doorframe having the icons describing how the present system works with the reflective devices in low light, smoke and/or darkness.
Figure 19:
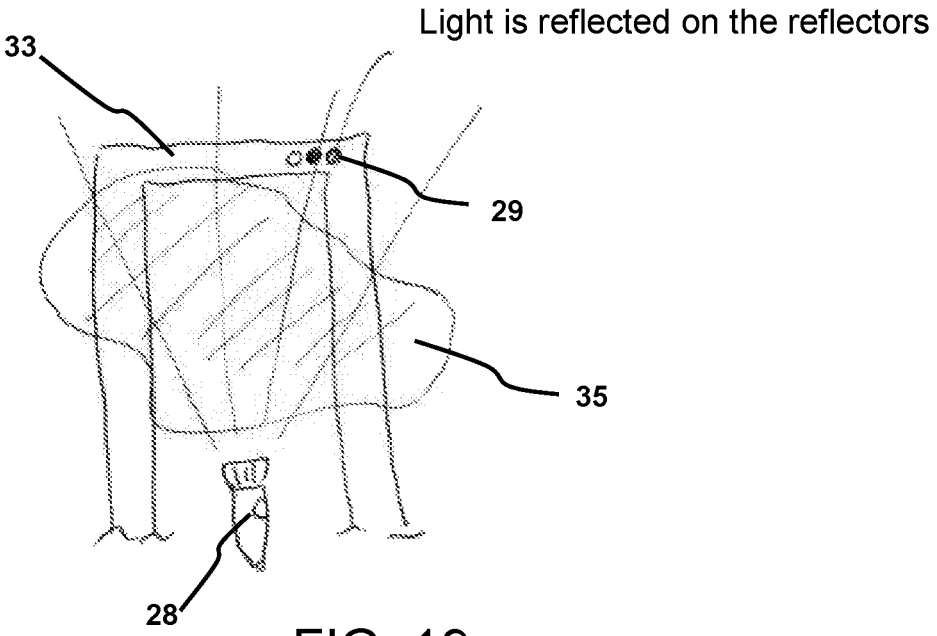
FIG. 19 is also a door with a doorframe having the icons describing how the present system works with the reflective devices in low light, smoke and/or darkness.

As illustrated in FIG. 10, the reflective device 19*b* may include an ornamental shape of the at least one of the occupants and the hazardous materials. For example, the reflective device 19*b* may be in the shape of a cat or dog. Additionally, the reflective device 19*b* may be in the shape of a wheelchair, a baby, a poison indicator, an explosives indicator, and the like.

Depending on the progress of the smoke from the fire engulfing the structure amidst pitch black darkness, the first responder directs his flashlight in the direction of the coded reflective colored icon/ornament or taped surface. For exemplary purposes, the coded display, a sampling of suggested colors, reveals the presences of handicapped (baby blue), pet (green), senior (purple), children (pink), toxic (red), explosive (yellow) and radioactive (orange). Sub categories for various types of pets, like birds, snakes, horses, cows, pigs and etcetera is possible. Iconic shapes of cats and dogs, as well as other farm animals can be created/offered in their conforming colors.

The main purpose of the present invention is to warn first responders and speed up their decision-making skills; and offer greater assurances against possible unknown dangers. It would additionally be advisable for end users, to also invest in displaying these reflective icons inside the structure; to act as reflective illuminative bread crumbs, to guide the first responders to occupants or items requiring immediate attention.

As an example, when the emergency responder shines his or her lit flashlight, piercing through the low light, smoke and/or darkness to a designated location on the door, door frame or threshold, the present colored reflective icons immediately reflect the light, alerting, advising or warning the responder of the persons, pets and potential hazards with the dwelling and the building structure. Additionally and alternative use, as mentioned earlier, during this same chaotic conditions this invention could be used as entry door locator; where conditions in apartment houses, hotels and cruise ships are the most affected by the combination of low light, darkness and heavy smoke.

Based upon the forewarning of the reflected colored icons, the first responders can proceed normally with varying caution that may also require specialized gear, equipment and maybe specialized personnel. The first responder's reaction time to the revealed situation, could be enhanced; and cause the internal victims of the fire to receive faster aid. In addition, the first responders would also reap of the benefit that specific, previously unknown, dangers are present or not present. And with the revealed knowledge of these dangers, they can take steps to safe guard their own safety by conforming to these dangers, by wearing the correct equipment or complying to specific situations, including early warning to solicit the help of specialized personnel.

Because of the minimal non-intrusive sizes of the reflective icons/ornaments/tapes and/or reflective surfaces, and because of their economic costs; the end users has space and can afford multiple icons displayed at the same time. The icons themselves are displayed in a standardized position/location above entry threshold, typically not readily visible to the casual passersby. End users that are multiple seniors may have an icon for each senior. The same goes to multiple pets, children and any combination of living things or contents needed to be displayed. A complete series of multiple icons may disclose the exact number of all things needing attention. For example, two purple, one light green and one orange may mean two seniors, one pet cat and a source of radioactive material.

Additionally, occupants and pets can wear iconic necklaces, bracelets and collars to guide first responders to their location within the burning structure, if they are not audibly able to communicate or respond; due to unconsciousness or competing noises. End users would not necessarily wear these icons 24/7, but would have the option to do so; or put on themselves, at the outbreak of a fire. Additionally, the system could to be enhanced to be used wide spread in the commercial fields, including commercial trucking, commercial airplanes, resort ships, passenger trains and resort hotels.

It should be understood, of course, that the foregoing relates to exemplary embodiments of the invention and that modifications may be made without departing from the spirit and scope of the invention as set forth in the following claims.

What is claimed is:

1. A method of communication of a fire alarm with first responders that indicates different types of occupants of a dwelling consisting of the steps of providing more than one reflective designated colored icon device; wherein the reflective designated colored icon device is selected from a color coded reflective system; coupling the more than one reflective designated colored icon device to an exterior surface of the dwelling at a point of entry; wherein the more than one reflective designated colored icon device is selected from a group consisting of being indicative of people of varying ages, being indicative of animals regarded as pets and being indicative of hazardous material; wherein the more than one reflective designated colored icon device reflects light and is visible within a low light, heavy smoke and darkness environment when light from a flashlight from the first responders reflects upon it; and wherein each reflective designated colored icon device is separable from each adjacent reflective designated colored icon device; and each of the reflective designated colored icon device is placed as a group on the exterior surface of the dwelling.

2. The method of claim 1, further comprising the steps of including one of the following dwellings: a house, a multi-plex, an apartment, an apartment multi-plex, a motel, a resort hotel, a train and a ship.

3. The method of claim 1, further comprising the steps of including wherein the more than one reflective designated colored icon device is selected from a group consisting of the following: baby blue indicating a handicapped individual is within the dwelling, dark green indicating a dog is within the dwelling, light green indicating a cat is in the dwelling, pink indicating a child is in the dwelling, red indicating a toxic material is within the dwelling, yellow indicating an explosive is within the dwelling, orange indicating a radio-active material is within the dwelling, and purple indicating a senior is within the dwelling.

* * * * *